United States Patent [19]

Hahn

[11] Patent Number: 4,582,310

[45] Date of Patent: Apr. 15, 1986

[54] PATIENT SUPPORT TABLE

[75] Inventor: Alfred Hahn, Erlangen, Fed. Rep. of Germany

[73] Assignee: Siemens Aktiengesellschaft, Berlin & Munich, Fed. Rep. of Germany

[21] Appl. No.: 670,048

[22] Filed: Nov. 9, 1984

[30] Foreign Application Priority Data

Dec. 6, 1983 [DE] Fed. Rep. of Germany ..... 3344054

[51] Int. Cl.[4] ..... A61G 13/00

[52] U.S. Cl. ..... 269/322; 254/122

[58] Field of Search ..... 269/322–327; 254/9 R, 9 B, 9 C, 122; 187/18; 182/63, 69, 141

[56] References Cited

U.S. PATENT DOCUMENTS

| | | | |
|---|---|---|---|
| 2,127,146 | 8/1938 | Smallen | 254/122 |
| 2,630,800 | 3/1953 | Voss et al. | 269/322 |
| 3,621,940 | 11/1971 | Lodige | 254/122 |
| 3,991,428 | 11/1976 | Hanson . | |
| 4,159,822 | 7/1979 | Ota et al. . | |

FOREIGN PATENT DOCUMENTS

| | | |
|---|---|---|
| 1566654 | 8/1979 | Fed. Rep. of Germany . |
| 2024616 | 1/1978 | United Kingdom . |

*Primary Examiner*—Robert C. Watson

*Attorney, Agent, or Firm*—Hill, Van Santen, Steadman & Simpson

[57] ABSTRACT

An x-ray examination table having a trestle on which a patient support platform is height-adjustably mounted, characterized by the trestle having a liftable member on which the table is mounted being connected to a base by a double-jointed support arrangement and being movable to the base by a lifting arrangement. The double-jointed support arrangement includes a pair of brackets pivotally connected together and having one of the pair being pivotally connected to the liftable member and the other being pivotally connected to the base. The pivotal connections are shafts which extend parallel to each other for each linkage arrangement and perpendicular to the shafts of the adjacent linkage arrangement so that the double-jointed supports guide the liftable member as it is moved between the upper and lowermost positions.

5 Claims, 3 Drawing Figures

PATIENT SUPPORT TABLE

BACKGROUND OF THE INVENTION

The present invention is directed to a patient support table comprising a trestle having an upper or liftable member on which a patient support platform is mounted and a base which is connected to the upper member by a scissors jack arrangement.

Patient support tables of this type are employed, for example, in angiography for the representation or visualization of blood vessels. In this case, it is desirable that the patient be readily accessible to the physician from all sides. In addition, the patient support platform is mounted on a trestle having small dimensions and is capable of being lowered to a great extent in order that an easy transfer of the patient from the bed to the patient support platform is possible. In addition, the lifting height of the trestle is to be so great than an optimum working height for the physician can be obtained.

A patient support table of the prior art is described and disclosed in German AS No. 15 66 654. In the patient support table disclosed in this patent, the length and width of the trestle are, indeed, relatively small. However, on account of the coupling of the scissors jack to the base of the pedestal of the patient support platform, only a relatively small elevation is possible.

SUMMARY OF THE INVENTION

The object of the present invention consists in designing a patient support table of the type having a trestle having a lifting or upper member and a base interconnected by a scissors jack and which with simple construction elements, a small area for the trestle is utilized and the trestle enables both a low minimum table height and an optimum working height.

In order to obtain these features, the present invention is directed to an improvement in a patient support table comprising a trestle having a base interconnected by a scissors jack to a liftable or upper member on which a patient support platform is mounted for raising and lowering. The improvements comprise that both the liftable member and base consist of box-shaped parts capable of being telescopically inserted within one another and that the scissors jack are coupled to the ends of the liftable member and the base and are designed in such a fashion that their arms are capable of moving to both sides from a closed extended position in which the arms extend parallel to each other.

In the case of the present invention, the arms of the scissors jack are disposed approximately horizontal when the upper end of the base and the lower end of the liftable member are disposed approximately at the same level. From this position, the jacks can be pivoted in both directions so that a telescoping together of the liftable member and base is possible on the one hand and a greater separation of the lifting member from the base is also possible on the other hand. The maximum amount of movement in either direction will be determined by the dimensions of the arms of the scissors jack. The overall lifting height accordingly results from the stroke of the scissors jack which is possible from the parallel extended position toward both sides.

DESCRIPTION OF THE PREFERRED EMBODIMENTS

Figure 1:
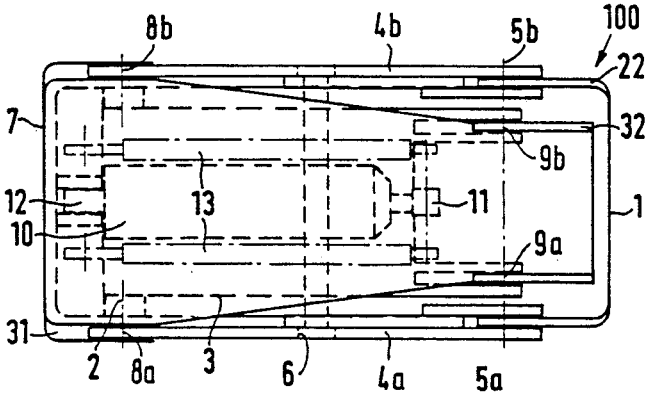
FIG. 1 is a plan view of the trestle for the table of the present invention without the support platform.
Figure 3:
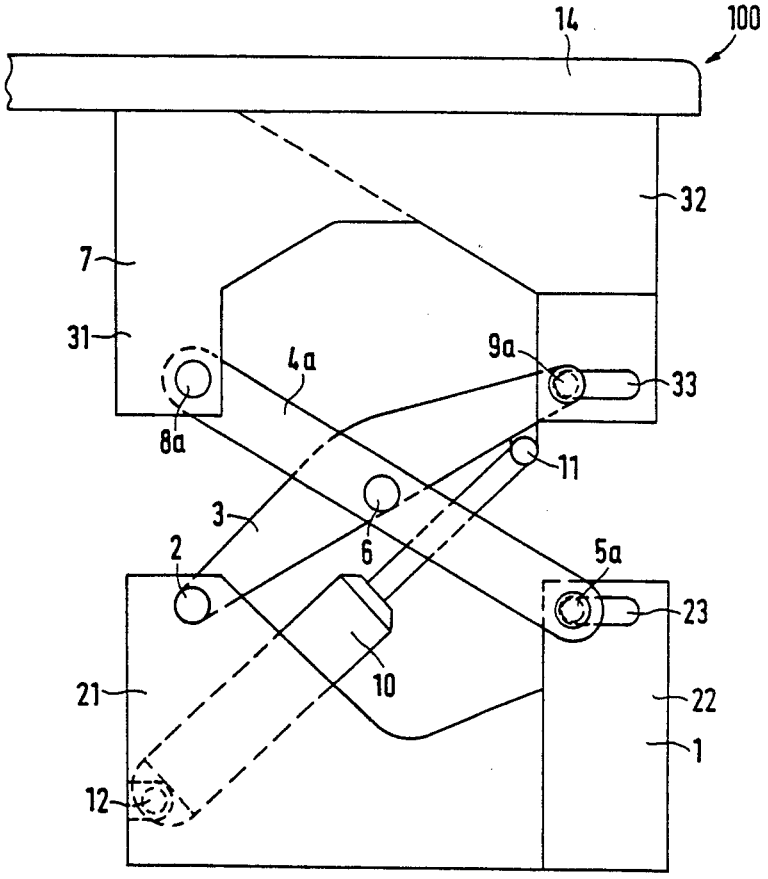
FIG. 3 is a side view of the table of FIG. 2 while in the uppermost position.

The principles of the present invention are particularly useful in a patient support table generally indicated at 100 in the Figures. The table 100, as best illustrated in FIG. 3, has a trestle composed of a pedestal or base 1 and an upper or liftable member 7 which supports a patient support platform 14. The base 1 has a first end 21 and a second end 22 while the upper or liftable member 7 has a first end 31 and a second end 32. The first end 21 of the base 1 supports a first scissor arm 3 on a shaft 2. A second scissor arm which consists of two support parts or arms 4*a* and 4*b* (FIG. 1), has one end connected in slots 23 in the second end 22 by bearing guides 5*a* and 5*b*, respectively. The other end of the arms 4*a* and 4*b* are connected to the first end 31 of the upper member 7 by guides or shafts 8*a* and 8*b*. The second end of the upper member or liftable member 7 has slots 33 which receive bearing guides 9*a* and 9*b* of the first arm 3.

Figure 2:
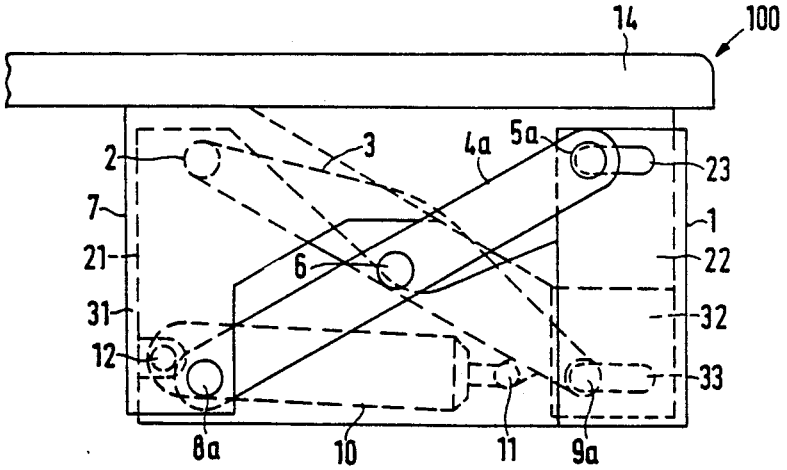
FIG. 2 is a side view of the table with the trestle mounted in the lowermost position.

It is apparent from the Figures that the base 1 and the liftable member 7 each consist of box-shaped parts capable of being telescopically arranged in each other. For example, the first end 21 of the base 1 is telescopically received in the first end 31 of the upper member 7 while the second end 32 of the upper member 7 is telescopically received inside of the second end 22 of the base 1 when the two members are in their lowermost position (see FIGS. 1 and 2). This telescopic engagement is possible because these parts are cut out in a V formation. The respectively narrow end such as the first end 21 of the base 1 is received in the wider first end 32 of the upper part 7 while the narrow second end 32 of the upper part or member is received in the wider second end of the base 1. In the lowermost position which is illustrated in FIG. 2, the guides 9*a* and 9*b* are disposed inside of the guides 5*a* and 5*b* and the shaft 2 is disposed inside of the shafts 8*a* and 8*b*. It is noted that a shaft 6 pivotably connects the arms 3 to the parts 4*a* and 4*b* and also is surrounded by the members forming the base 1 and the liftable member 7.

As a lift element, an electro-thrust motor 10 is provided and is connected to a shaft or pivot point 11 on the lower side of the scissor arm 3 and has the other end connected to the base 1 by a pivotal connection or shaft 12. In order to reinforce the lift drive, pneumatic springs 13 (FIG. 1) extend between the same two shafts 11 and 12. The pneumatic springs 13 are designed for a minimum load and will reduce the necessary power for the lift device.

It should be noted that in order to prevent being caught in the moving parts, the entire lifting system of the trestle can be covered by a telescopic tube or bellows. The safety risk is reduced by the presence of the tube or bellows.

It is important that the scissors jack arms 3, 4*a* and 4*b* are coupled to the ends of the liftable member 7 and to the base 1 and that they are so designed that the arms 3, 4*a* and 4*b* are capable of traveling to either side of the extended parallel position so that the parts such as the base 1 and the liftable member 7 are capable of telescopic engagement as illustrated in FIG. 2 on the one hand and can be lifted to a maximum amount of separation therebetween as illustrated in FIG. 3. Thus, the arms 3, 4*a* and 4*b* can be moved so that their ends pass through the horizontal position.

Although various minor modifications may be suggested by those versed in the art, it should be understood that I wish to embody within the scope of the patent granted hereon, all such modifications as reasonably and properly come within the scope of my contribution to the art.

I claim:

1. In a patient support rable comprising a trestle having a base interconnected by a scissors jack to a liftable member on which a patient support platform is mounted for raising and lowering, the improvements comprising the liftable member and base each consisting of telescopically engageable box-shaped parts and the scissors jack comprises a pair of pivotally connected arms which have their ends pivotably coupled directly to the box-shaped parts at the ends of the liftable member and the base and are constructed with the respective arms being capable of traveling outwardly on both sides of a closed position with the arms extending parallel to each other so that the trestle can be moved from a lowermost position with the arms extending diagnonally to each other and with the box-shaped parts of the base and liftable member being telescoped together, upward to a position with the arms extending parallel to each other and then to a further higher position with the arms again extending diagonally to each other in the opposite direction.

2. In a patient support table comprising a trestle having a base interconnected by a scissors jack to a liftable member on which a patient support platform is mounted for raising and lowering, the improvements comprising the liftable member and base each consisting of telescopically engageable box-shaped parts with first and second ends with the first end of the box-shaped part of the base extending telescopically into the first end of the box-shaped part of the liftable member as the second end of the box-shaped part of the liftable member extends telescopically into the second end of the box-shaped part of the base and said scissors jack comprises a first arm pivotally connected to a second arm with the first arm having one end pivotally connected by a direct connection to the first end of the box-shaped part of the base and the other end pivotally connected by a direct connection to the second end of the box-shaped part of the liftable member while the second arm has one end pivotally connected by a direct connection to the first end of the box-shaped part of the liftable member and the other end connected by a direct connection to the second end of the box-shaped part of the base and said first and second arms being constructed so that a lowermost position is obtained with the connections of the arms of the scissors jack to the liftable member being disposed lower than the connections to the base and an upper position with the ends of the arms connected to the liftable member being positioned above the connections to the base.

3. In a patient support according to claim 1, wherein each of the arms has a longitudinal axis and the pivotable connection and a point of each end which is pivotably coupled to the box-shaped parts lies substantially on the longitudinal axis of the arm.

4. In a patient support according to claim 1, wherein the box-shaped part of the base has two portions of different sizes and the box-shaped part of the liftable member having two portions of different sizes, said portions being arranged with a portion on the base at one end telescopically receiving the portion of the liftable member and the portion on the other end of the base being telescopically received in the portion of the liftable member when the liftable member is in the lowermost position.

5. In a patient support table according to claim 2, wherein each direct connection between the first arm and the second end of the box-shaped part of the liftable member and between the second arm and the second end of the box-shaped part of the base includes a bearing member received in an elongated slot.

* * * * *